United States Patent [19]

Ayotte

[11] 4,350,112

[45] Sep. 21, 1982

[54] OCEAN TRANSPORTER VESSEL

[76] Inventor: Arthur E. Ayotte, 21340 NE. 14 Ave., Miami, Fla. 33179

[21] Appl. No.: 562,282

[22] Filed: Jul. 1, 1966

[51] Int. Cl.[3] ..... B63B 35/035
[52] U.S. Cl. ..... 114/260
[58] Field of Search ..... 114/43.5, 72, 259, 260; 214/84; 414/137, 138, 140

[56] References Cited

U.S. PATENT DOCUMENTS

| | | | |
|---|---|---|---|
| 2,116,150 | 5/1938 | Howie et al. | 214/84 |
| 2,370,916 | 3/1945 | Reedy | 114/43.5 X |
| 2,411,133 | 11/1946 | Hill | 214/84 |
| 2,942,425 | 6/1960 | De Long et al. | 114/43.5 X |
| 2,988,036 | 6/1961 | Mooneyhan et al. | 114/43.5 UX |
| 3,033,152 | 5/1962 | Le Tourneay | 115/6 |
| 3,191,568 | 6/1965 | Schroeder et al. | 114/74 |
| 3,273,527 | 9/1966 | Goldman | 114/72 X |
| 3,318,276 | 5/1967 | Nemec | 114/43.5 |

FOREIGN PATENT DOCUMENTS

| | | | |
|---|---|---|---|
| 689310 | 3/1953 | United Kingdom | 114/43.5 |

*Primary Examiner*—Trygve M. Blix
*Assistant Examiner*—Jesús D. Sotelo
*Attorney, Agent, or Firm*—Mawhinney & Mawhinney & Connors

[57] ABSTRACT

The disclosure of the invention pertains to a multipurpose ocean carrier into which a full cargo of barges or other vehicles can be loaded by first submerging the carrier to a point where the lower deck of the carrier is submerged deeply enough to allow barges to be floated through a lower opening in the hull through an elevator well onto the lower deck. When the lower deck is filled, the barges are floated onto an elevator platform and lifted thereby into alignment with the upper deck onto which the barges are towed by an overhead towing device. Rollers are provided on the elevator platform and the upper deck to facilitate the towing of the barges and the rollers are lowered below the surface of the platform and the upper deck after the carrier has been loaded.

7 Claims, 15 Drawing Figures

OCEAN TRANSPORTER VESSEL

This invention relates to a novel and useful ocean transporter vessel and more specifically to a "mother-type" of vessel including a plurality of vertically spaced load supporting or cargo decks and a well defined at one end of the vessel with which the adjacent ends of the vertically spaced cargo decks of the vessel are registered and in which a vertically movable elevator platform is mounted for horizontal registry with the vertically spaced cargo decks. Further, the vessel of the instant invention includes an outer opening communicating the lower portion of the well with the exterior of the vessel and the outer opening is provided with a closure door movable between an open position allowing free passage of floating load carriers through the outer opening into the well and a closed position sealing the well from the exterior of the boat.

The lowermost cargo deck is in general horizontal alignment with the sill of the outer opening and an inner door is provided for the rear end of the area disposed between the lower-most cargo deck and the upper cargo deck whereby this area may be sealed from the lower end portion of the well. Further, the outer opening has its sill disposed above the water level of the vessel when the latter is unladen and the vessel includes buoyancy tanks which may be flooded and pumped free of water to maintain both transverse and longitudinal trim of the vessel and to raise and lower the vessel in the water in a manner such that the sill of the outer opening may be lowered below the level of the ambient water for floating barges and other displacement type hulls from the ambient water into the lower end portion of the well when the latter is also flooded to the level of the ambient water.

Further, the lower cargo deck, which may be flooded from the well, includes means (not shown) for locking of securing a load carrier such as a barge positioned thereon against movement relative thereto when water is expelled from the area between the upper and lower decks and the inner door between that area and the lower end of the well is closed. In addition, the vertical movable elevator platform or member includes roller means which may be extended above the floor thereof to rollingly support a barge or the like disposed on the elevator member when the elevator is lifted from the water to thereby enable the barge to be moved off the elevator and onto the upper cargo deck of the vessel when the elevator is registered therewith. Further, the upper cargo deck of the vessel includes means in the form of an overhead tractor whereby barges or other load carriers disposed on the elevator member may be pulled from the elevator member and moved along the upper cargo deck, the latter also including roller means which may be projected or extended above the floor thereof for facilitating the movement of laden load carriers therealong.

Finally, the wall portion of the vessel in which the outer opening is formed is also provided with an upper outer opening also communicating with the elevator well. However, the upper outer opening is communicated with an upper portion of the elevator well and is therefore adapted to receive cargo moved therethrough from a dock alongside of which the vessel is disposed, the vertically movable elevator member being registrable with the upper outer opening so as to be adapted to receive laden load carriers moved through the upper outer opening into the well for subsequent positioning of such laden load carriers on the vertically spaced decks of the vessel.

The main object of this invention is to provide an ocean transporter vehicle which will be adapted to handle many different types of laden load carriers such as barges, trailers, vehicles, individual cargo containers, and railway cars as well as other bulk cargo thereby not limiting the use of the vessel of the instant invention to one type of shipping trade which may not develop to the extent estimated or which may even decrease. The adaptability of the vessel of the instant invention to carry various types of laden load carriers will also adapt the vessel for varied types of use in conjunction with national defense should the need arise inasmuch as many types of cargo may be readily handled and carried thereby in an efficient manner.

A further object of this invention is to provide a vessel in accordance with the preceding object and which is constructed in a manner whereby the cargo being loaded thereinto may be floating cargo such as barges and other types of laden displacement hulls as well as various types of cargo such as vehicles, trailers and railway cars which are conventionally assembled on a dock to be loaded upon a ship diposed alongside the dock.

Yet another object of this invention is to provide a vessel in accordance with the preceding objects and which is constructed in a manner whereby the loading and unloading position thereof may be disposed at either end of the vessel or on either side of the vessel and which may be duplicated if desired so as to exist at one or more ends and on one or more sides of the vessel.

A final object of this invention to be specifically enumerated herein is to provide a vessel which will conform to conventional forms of manufacture, be of simple construction, and simple in operation so as to provide a device that will be economically feasible, long lasting and relatively trouble free in operation.

These together with other objects and advantages of operation which will become apparent hereinafter are realized by the structural details of the invention and its operation hereinafter described and claimed with reference to the description to the various parts and elements of the invention by numerals also applied to the accompanying drawings, it being understood that changes may be made in the construction and arrangement of parts without departing from the spirit of the invention as claimed.

Referring to the drawings.

Figure 10:
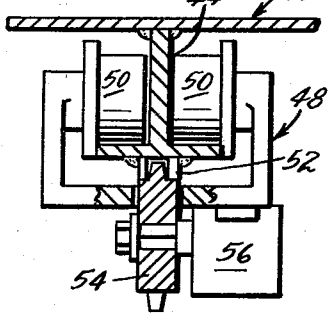
Figure 3:
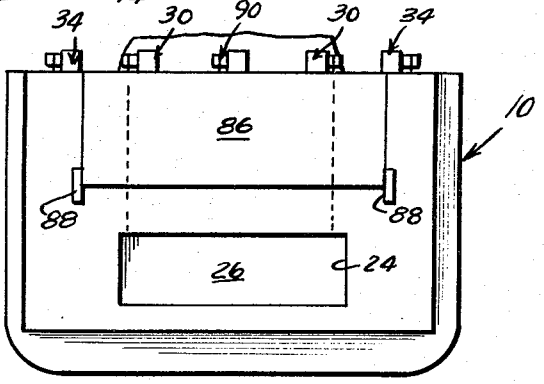
FIG. 3 is a rear elevational view of the vessel illustrating the stern end thereof.
Figure 4:
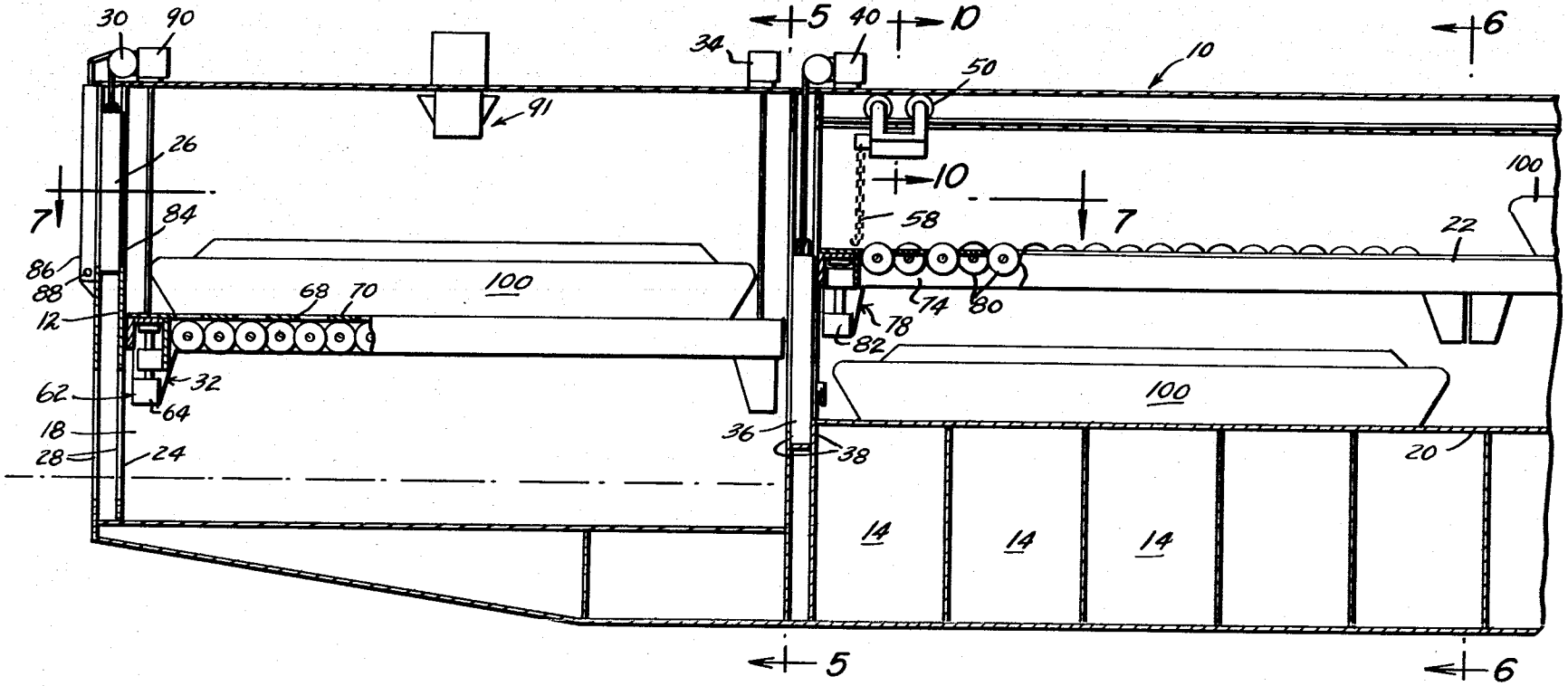
FIG. 4 is an enlarged fragmentary longitudinal vertical sectional view taken substantially upon the plane indicated by the section line 4—4 of FIG. 1.
Figure 5:
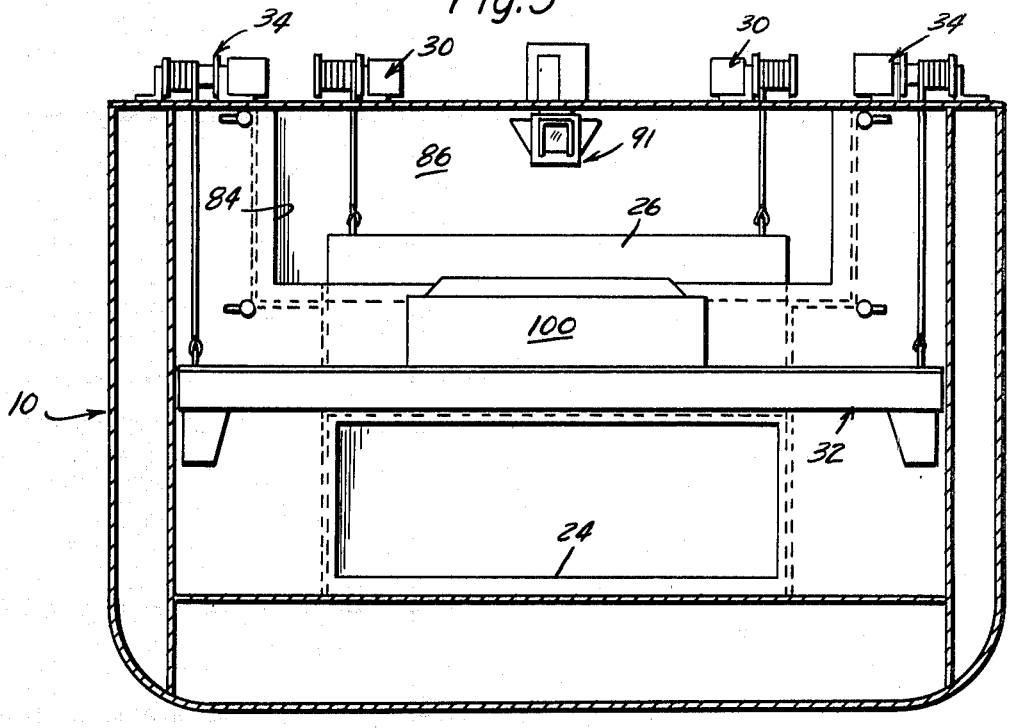
FIG. 5 is a transverse vertical sectional view taken substantially upon the plane indicated by the section line 5—5 of FIG. 4.
Figure 7:
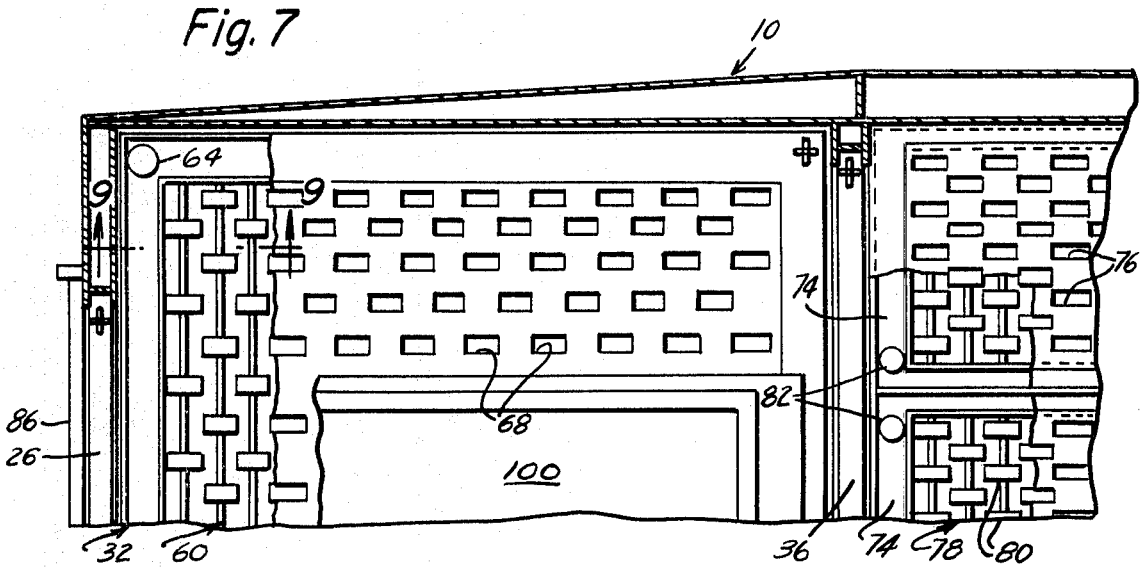
FIG. 7 is a fragmentary horizontal sectional view taken substantially upon the plane indicated by the section line 7—7 of FIG. 4.
Figure 11:
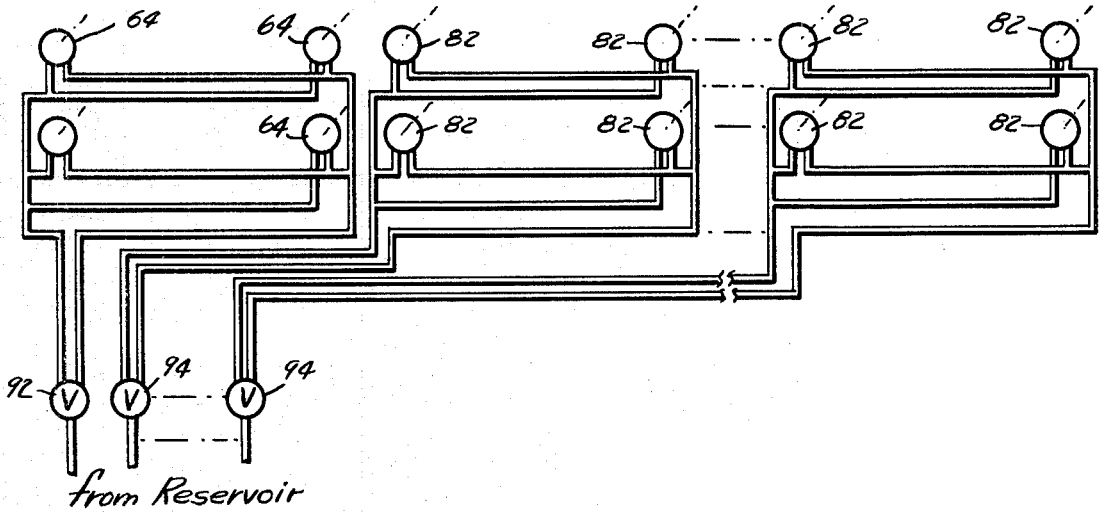
Figure 12:
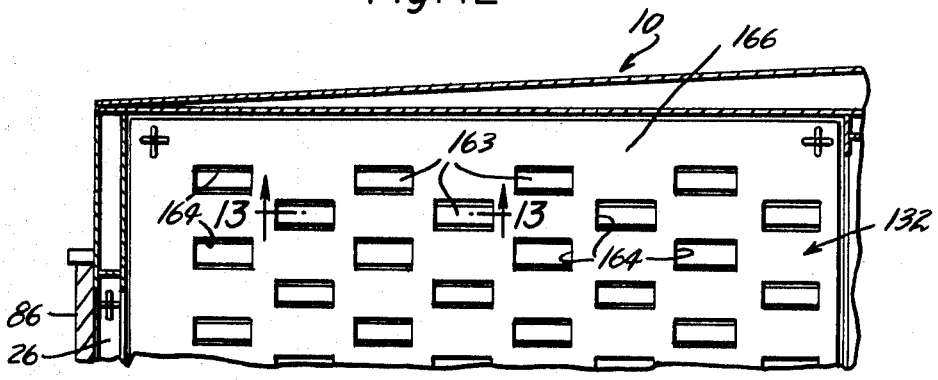
Figure 13:
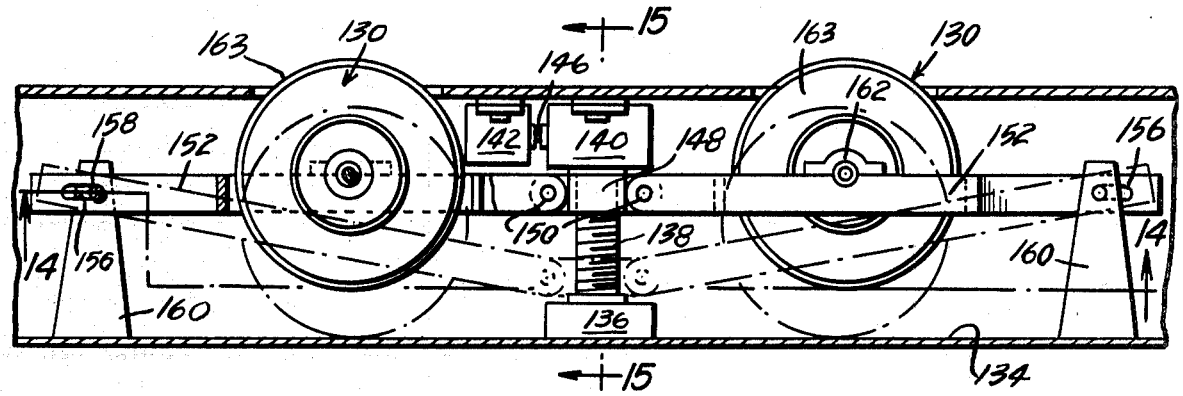
Figure 14:
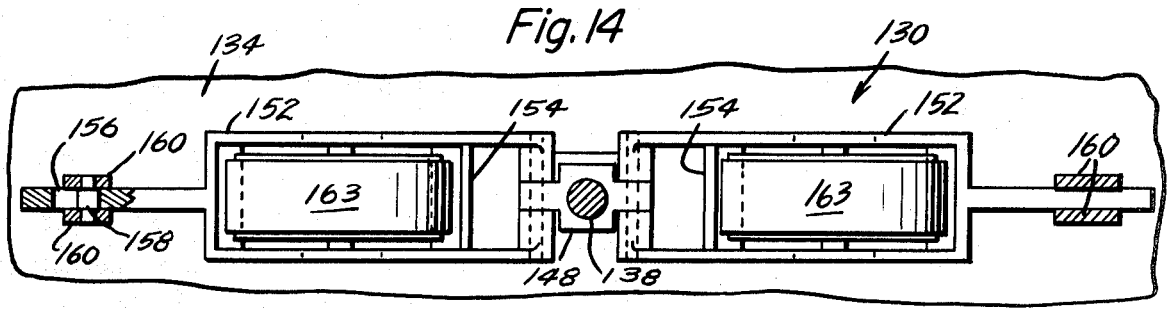

FIG. 10 is an enlarged fragmentary transverse vertical sectional view taken substantially upon the plane indicated by the line 10—10 of FIG. 4 and illustrating a typical positive sprocket and rack gear drive of the overhead tractor assembly utilized to shift laden load carriers from the vertically shiftable elevator member to the upper cargo deck of the vessel with which the elevator member is registrable and vice versa;

FIG. 11 is a diagrammatical view of one typical valve arrangement operable to actuate the various fluid motors for powering the roller support assemblies of the elevator member and the upper cargo deck, the valve arrangement of FIG. 11 being adapted to be disposed in a location remote from the associated fluid motors for actuation of the latter from a central control point;

FIG. 12 is a fragmentary view similar to FIG. 7, illustrating a modified form of the deck roller assemblies of the instant invention;

FIG. 13 is a sectional view taken on the line 13—13 of FIG. 12;

FIG. 14 is a sectional view taken on the line 14—14 of FIG. 13, and

Figure 15:
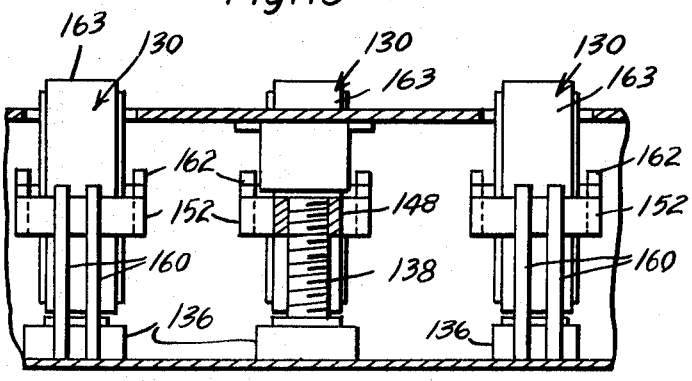

FIG. 15 is a sectional view taken on the line 15—15 of FIG. 13.

Referring now more specifically to the drawings, the numeral 10 generally designates the vessel of the instant invention. The vessel 10 defines a hull including a generally straight and transversely extending stern wall portion 12. The hull 10 includes a plurality of transversely and longitudinally spaced individual buoyancy compartments 14 in its lower portion and each buoyancy compartment 14 includes conventional means (not shown) for flooding the compartment as well as for pumping water out of the compartment. Inasmuch as the compartments 14 may be individually flooded or pumped dry of water, the transverse and longitudinal trim of the vessel 10 may be readily varied as desired, in the conventional manner. Further, by flooding all of the compartments 14 at the same time, the water level of the hull 10 may be raised for a purpose to be hereinafter more fully set forth.

The vessel 10 includes a pair of opposite side engine rooms 16 spaced transversely of the vessel and the stern or rear portion of the vessel includes an upstanding elevator well 18. Further, a lower cargo deck 20 is disposed over the buoyancy compartments 14 and extends longitudinally of the vessel 10 from the elevator well 18 to a point adjacent the bow of the vessel. In addition, the vessel 10 also includes an upper cargo supporting deck 22 spaced vertically above the lower deck 20 and also extending from the elevator well 18 to a point adjacent the bow of the vessel 10. The rear or stern wall portion 12 includes a low opening 24 generally horizontally aligned with the lower cargo deck 20 and the lower portion of the opening 24 is disposed adjacent the normal water level on the vessel 10.

An outer door 26 is supported on the rear wall portion 12 for vertical movement relative thereto by means of guide structure 28 provided therefor and may be raised and lowered in the guide structure 28 by means of winch assemblies 30 supported from the upper deck portion of the vessel 10. The outer door 26 may be shifted from the upper position thereof illustrated in solid lines in FIG. 4 of the drawings downwardly toward a lower position closing the lower opening 24 in a fluid-tight manner.

An elevator member generally referred to by the reference numeral 32 is disposed in the well 18 and is supported for vertical movement therein by means of winch assemblies 34 also supported from an upper deck portion of the vessel 10. The winch assemblies 34 are positioned so as to support the four corners of the elevator member 32 and may be operated in unison so as to maintain the elevator member 32 in a horizontally disposed position during its vertical movement.

The vessel 10 additionally includes an inner door 36 supported for vertical movement from guide structure 38 provided therefor. The inner door 36 is supported from winch assemblies 40 for vertical movement between the lowered position illustrated in solid lines in FIG. 4 of the drawings forming a water-tight closure between the well 18 and the area disposed between the decks 20 and 22 and an upper position allowing free communication between the well 18 and the lower deck 20 and in horizontal registry with the adjacent end of the area disposed immediately above the upper deck 22.

A plurality of overhead and longitudinally extending support beams 44 are disposed above the deck 22 and each has a tractor or carriage assembly generally referred to by the reference numeral 48 supported therefrom and for movement longitudinally therealong by means of rollers 50 journalled from the associated carriage. In addition, each of the support beams 44 includes a downwardly facing and longitudinally extending rack gear 52 with which a gear wheel 54 driven by a motor 56 supported from the corresponding carriage 48 is meshed. Therefore, the motors 56 are operable to cause the carriages 48 to traverse the beams 44 and each of the carriage 48 is provided with load engaging means in the form of a tension member 58 and may therefore be utilized to shift a load supported from the deck 22 longitudinally of the latter.

Figure 9:
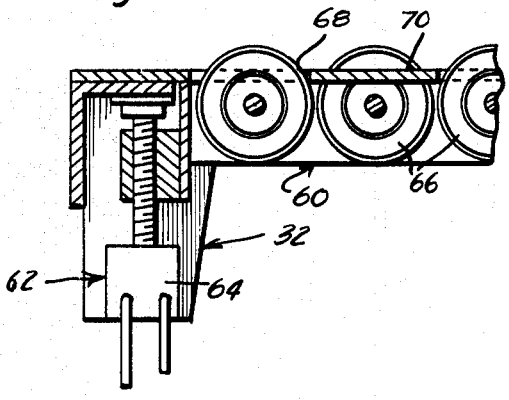
FIG. 9 is a fragmentary vertical sectional view similar to that of FIG. 8 but illustrating the wheel or roller assembly in a raised position.
Figure 8:
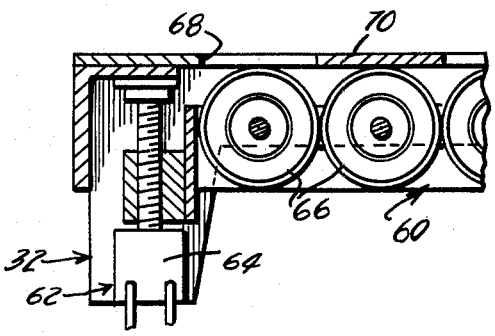
FIG. 8 is an enlarged fragmentary vertical sectional view taken substantially upon the plane indicated by the section line 9—9 of FIG. 7 and illustrating a typical vertically adjustable wheel or roller assembly employed on the vertical adjustable elevator member of the instant invention.

The elevator member 32 includes a vertical adjustable roller support assembly generally referred to by the reference numeral 60 and which is supported from the elevator member 32 at the four corners of the latter by means of screw-jack assemblies 62 driven by means of fluid motors 64. The roller support assembly 60 rotatably journals a plurality of wheels or rollers such as pneumatic tires 66 and the tires 66 are movable between positions projecting upwardly through openings 68 provided therefor in the floor 70 of the elevator member 32 and lowered positions spaced beneath the upper surface of the floor 70 by vertical adjustment of the roller support assembly 60 upon actuation of the fluid motors 64, see FIGS. 8 and 9.

Figure 1:
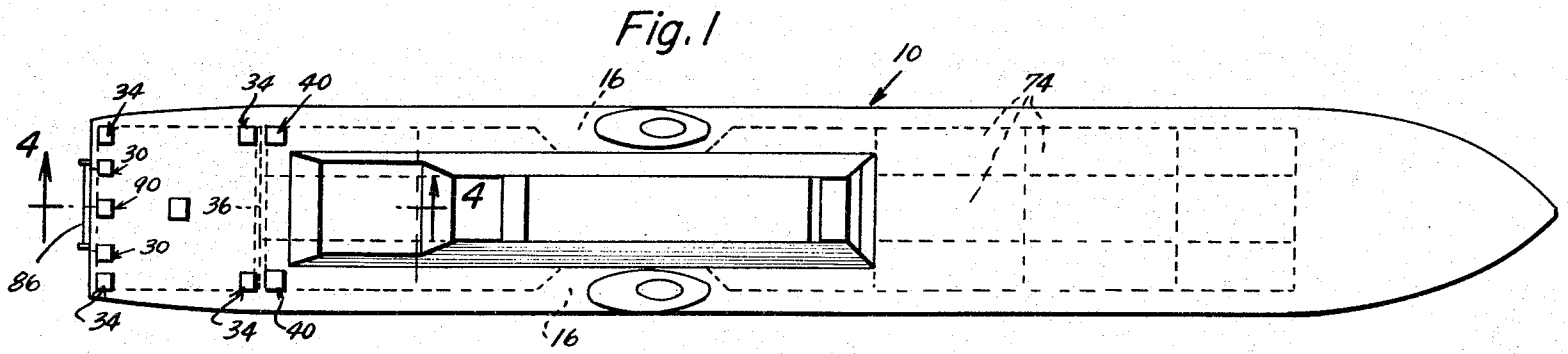
FIG. 1 is a diagrammatical top plan view of a preferred form of the invention illustrating the several compartments thereof in broken lines.
Figure 2:
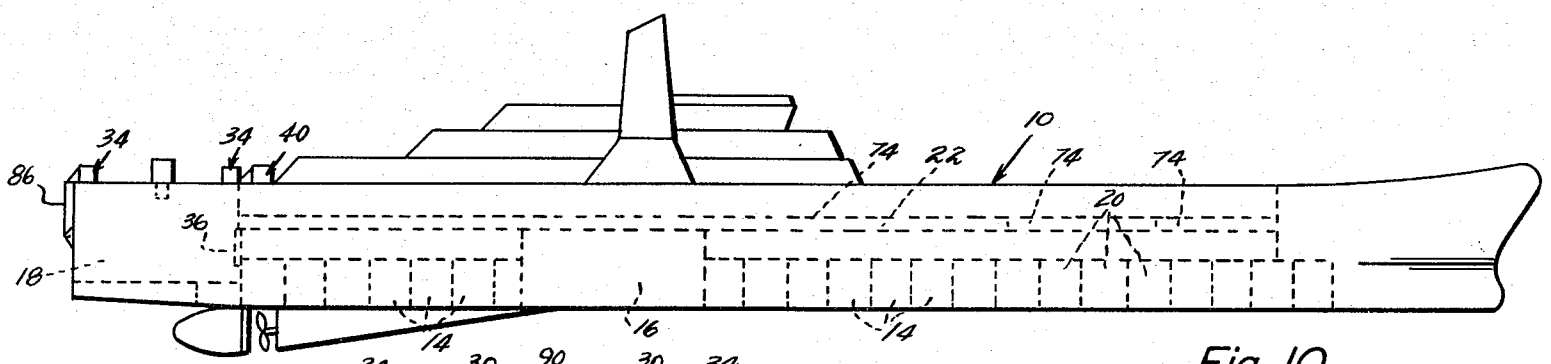
FIG. 2 is a side elevational view of the embodiment illustrated in FIG. 1.
Figure 6:
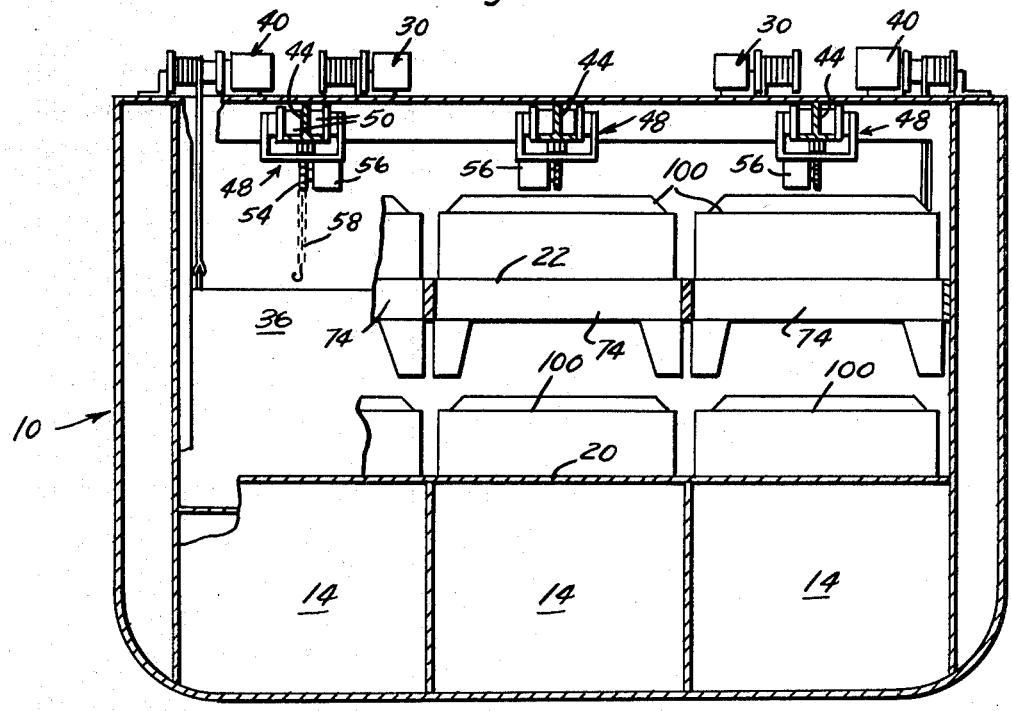
FIG. 6 is a transverse vertical sectional view taken substantially upon the plane indicated by the section line 6—6 of FIG. 4.

In addition, it will be noted from FIGS. 1 and 6 of the drawings that the upper cargo deck 22 is divided into a plurality of longitudinally and transversely spaced stationary deck sections 74. Each of the deck sections 74 includes a plurality of openings 76 corresponding to the openings 60 and also a roller support assembly generally referred to by the reference numeral 78 corresponding to the roller support assembly 60 and including a plurality of rollers or tires 80 corresponding to the tires 66. Of course, the lower support assemblies 78 are each also supported from the corresponding section 74 by means of screw-jack assemblies generally referred to by the reference numeral 82 corresponding to the screw-jack assemblies 62.

The rear wall portion 12 of the vessel 10 includes an upper opening 84 disposed above the lower opening 24 and a swingable closure door 86 is pivotally supported from the rear wall portion 12 as at 88 and may be swung between the upstanding position illustrated in FIG. 4 of the drawings and a downwardly and outwardly inclined position (not shown) defining a loading ramp for the upper opening 84. A winch assembly 90 is provided and operatively connected to the free swinging edge portion of the closure door 86 for swinging the latter between its open and closed positions.

An operator's cupola generally referred to by the reference numeral 91 is supported in depending fashion from the deck covering the upper end of the well 18 and includes control valves such as valves 92 and 94, for controlling operation of the fluid motors 64 and 82. In addition, the operator's cupola 91 is also provided with conventional controls (not shown) for the winch assemblies 30, 34 and 90.

In operation, if the vessel 10 is to be utilized for transporting floatable cargo such as laden barges, the door 26 may be raised and the buoyancy compartments 14 and the lower part of the elevator well 18 may be flooded sufficiently to lower the vessel 10 in the water until the water level is above the lowermost extremity of the lower opening 24. Then, the elevator member 32 may be lowered to the bottom of the well 18 or raised to the top thereof and the inner door 36 may be opened to also flood the lower cargo deck 20. Then, the laden barges 100 may be floated into the well 18 through the opening 24 and down through the area disposed between the decks 20 and 22. Of course, there need be only a few inches of water beneath the barges 100 as they are floated toward the bow of the vessel 10 over the cargo deck 20. After the cargo deck 20 has been fully loaded, sufficient water within the buoyancy compartments 14 may be expelled therefrom exteriorly of the vessel 10 to cause the latter to rise in the water whereby the water within the area disposed between the decks 20 and 22 will flow outwardly therefrom and into the elevator well 18. Thereafter, the door 36 may be closed and the buoyancy tanks 14 may again have water admitted thereinto so as to again lower the vessel 10 sufficiently for additional barges to float into the well 18 and above the elevator member 32 which is then in a fully lowered position in the bottom of the well 18. Individual barges 100 may then be raised by the elevator member 32 into horizontal alignment with the upper deck 22 and pulled by means of the carriages 48 from the elevator member 32 downwardly along the deck 22 to the bow end of the vessel 10 after the roller support assemblies 60 and 78 have been raised. After the upper cargo deck 22 has been fully loaded, the roller support assemblies 78 may be lowered or retracted and the elevator member 32 may then again be lowered to its lowermost position and a final barge 100 may be floated into the elevator well 18 and raised by means of the elevator member 32 after which the latter may be locked in a raised position. One or more barges 100 then may be positioned in the lower part of well 18 and the door 26 may be closed. The water may then be expelled from the well by means of pumps (not shown). Thereafter, the vessel 10 may proceed to one or more destinations and unload the barges 100 by reversing the above procedure.

In lieu of allowing the water above the cargo deck 20 to flow outwardly therefrom through the elevator well 18, the inner door 36 may first be closed after floating the barges 100 over the cargo deck 20 and then the water disposed over the cargo deck 20 may be pumped therefrom by suitable pumps (not shown) provided for this purpose.

If the vessel 10 is to be loaded with cargo such as vehicles, loaded trailers and/or railroad cars and bulk cargo and the like disposed on a dock, the vessel 10 may be moored alongside the dock with the outer door 26 closed and the elevator well 18 pumped dry of water, suitable pumps (not shown) being provided for pumping the well 18 dry. Then, the upper closure door 86 may be opened and positioned so as to form a ramp from the dock to the vessel 10 and the cargo to be loaded on the vessel 10 may be moved across the loading ramp defined by the closure door 86 and onto the elevator member 32. In addition, such cargo may move straight across the elevator member 32 and onto the upper cargo deck 22. If the cargo to be loaded from dock-side is in the form of wheeled vehicles, suitable flooring members may be positioned on the elevator member and the upper deck 22 to cover the openings 68 and 76. Further, the elevator member 32 and the cargo deck 22 may be fitted with rails if the cargo to be loaded is in the form of railroad cars.

After the upper cargo deck 22 is fully loaded, the lower cargo deck 20 may be loaded by opening the inner door 36 and delivering individual elevator member loads of cargo to the lower deck 20 by loading the elevator member 32 through the upper opening 84, lowering the elevator member 32 into horizontal alignment with the lower cargo deck 20 and then moving the cargo from the elevator member 32 onto the cargo deck 20. If stability of the vessel is in question, the lower deck 20 is to be loaded by this means prior to the loading of upper deck 22.

Although the vessel 10 has been illustrated and described herein as having the elevator well 18 and associated parts disposed in the stern or aft portion of the vessel 10, the well 18 could be disposed in the bow portion of the vessel 10 or on either side of the vessel 10.

Referring particularly to FIGS. 12 through 15 of the drawings, there is disclosed a modified form of the deck roller assemblies 130 illustrated in the drawings as attached to the modified elevator assembly 132.

As seen more particularly in FIG. 13 of the drawings, there is attached to a solid base structure 134 of the assembly 132 by means of welding or in any suitable manner a bearing block 136, rotatably journaled in said bearing block is an upstanding threaded shaft 138 the upper end of which terminates within a gear box 140 and the shaft is rotated selectively in either direction by a gear (not shown but contained within a gear box 140). Connected to the gear train by means of a shaft 146 is a fluid motor 142, said fluid motor being selectively situated throughout the system as hereinbefore described in connection with the fluid motors 64 of the first form of the invention.

Threadedly received by the threaded shaft 138 is an apertured collar 148 and pivotally attached thereto by means of pins 150 are a pair of bifurcated arms 152 which are reinforced at intermediate points by means of web members 154. At the opposite end of the bifurcated arms 152, which terminate in a single section of material, is a slot 156 which is disposed slidably over a pin 158. Pin 158 is in turn fixedly supported by the solid deck 134 by a pair of upstanding support members 160. At the intermediate area of each bifurcated arm 152 is a bearing block 162 apertured to support in a freely rotatable manner a roller 163.

In the operation of the device, the fluid motor 142 will be energized imparting rotation to the gear train within the gear box 140, said gear train will actuate the threaded shaft 138 either clockwise or counterclockwise as desired and since the apertured collar 148 is held captive against rotation by the fixed relation of the arms 152 and the upstanding support members 160, the collar 148 will be raised or lowered as desired, the rollers 163 will be projected through the apertures 164 in the upper deck 166, as shown in full lines in FIG. 13, or be withdrawn from the apertures 164 to the phantom line position of FIG. 13.

What is claimed is:

1. An improved design of multi-purpose ocean carrier comprising a hull, at least one horizontal deck, said hull having fixed structural means, and a liftable elevator platform for raising floating units from the level of the water to the level of the deck, said platform being guided within said fixed structural means, and wherein there are provided an upper horizontal deck and a lower horizontal deck, a well is provided for the elevator platform defined by four walls of the hull, one of said walls has an upper and a lower opening communicating with the well and the upper and lower decks respectively, a slidable closure is provided for selectively sealing off the openings to the two decks, a second wall of the hull has an upper and a lower opening communicating with the ambient water and the well, there is provided a slidable closure for closing the lower opening in said second hull wall, and there is provided a hinged closure movable between an open and closed position for closing the upper opening in said second hull wall and for serving as a ramp when the upper portion of the well is above the ambient water and the hinged closure is in its open position.

2. A cargo vessel comprising a displacement-type hull including a lower cargo deck and at least one upper cargo deck vertically spaced above said lower deck, said decks extending longitudinally of said hull, said hull including means defining an upstanding elevator well adjacent and inwardly of one wall portion of said hull and including portions in registry with said upper and lower decks, said one wall portion of said hull having a low opening formed therein in general horizontal alignment with said lower deck, said hull including buoyancy tanks spaced transversely and longitudinally thereof and operative to be selectively flooded and emptied of water so as to adjust transverse and longitudinal trim of said hull as well as cause said hull to be raised and lowered in the water, said hull being lowerable in the water, by flooding at least some of said tanks, to shift the water line thereof sufficiently above the lower extremity of said low opening to enable smaller laden displacement-type hulls to be floated from the exterior of said hull through said low opening and into said well, said hull including water-tight doors shiftable into and out of position closing said low opening and sealing said lower deck from said well, said lower deck being floodable from said well and drainable therefrom, said well having vertically adjustable elevator means therein positionable below said hulls floated into said well and horizontally, registrable with said decks, said elevator means including means defining a load supporting floor therefor and load supporting roller means shiftable between lowered positions relative to said floor and upper positions projecting above said floor at a plurality of positions spaced throughout the plan area of said floor, said load supporting defining means including a threaded shaft, a collar threadedly mounted on said shaft, arms pivotally mounted at one end to said collar, support members fixed to a deck of the vessel, the other ends of the arms being connected to said support members by a pin and slot connection so that the arms restrain the collar from rotation when the shaft is rotated to cause the collar to ride up or down on the shaft depending on the direction of rotation of the shaft, rollers carried by said arms, gearing connected to the shaft and fluid motor means for actuating the gearing selectively in opposite directions to cause rotation of the shaft in opposite directions to cause the collar and the entrained arms and rollers to rise or fall to project the rollers upwardly through apertures in said deck or to withdraw said rollers from said apertures.

3. An improved design of multi-purpose ocean carrier comprising a hull, at least one horizontal deck, said hull having fixed structural means, and a liftable elevator platform for raising floating units from the level of the water to the level of the deck, said platform being guided within said fixed structural means, and load supporting roller means

4. An improved design of multi-purpose ocean carrier comprising a hull, at least one horizontal deck, said hull having fixed structural means, and a liftable elevator platform for raising floating units from the level of the water to the level of the deck, said platform being guided within said fixed structural means and wherein said elevator platform operates in an elevator well which is enclosed within the confines of said hull and said well has common access to said deck and to the ambient water, and a sliding water-tight closure is provided for voluntarily sealing off said well from the ambient water.

5. An ocean carrier as claimed in claim 4, wherein a hinged water-tight closure is provided for voluntarily sealing off said well from the ambient water and to serve as a ramp when the upper portion of the well is above the ambient water and the closure is in the open position.

6. An ocean carrier as climed in claim 4 wherein there are provided an upper and a lower horizontal deck into alignment with which the elevator platform is adapted to be brought, said upper deck includes means operatively associated therewith and adapted physically to shift loads from said elevator platform onto said upper deck and also along the latter, said means comprises an overhead tractor mounted for movement longitudinally of said upper deck for moving the loads along said upper deck.

7. A vessel, for carrying cargo loaded barges or the like, which vessel has a main hull for a portion of the length of the vessel and rearwardly extending, spaced apart hull portions to define a water area between the rearwardly extending hull portions of a width and length to receive a barge or the like therebetween, (a) a gate movably mounted between the rearwardly extending hull portions near the rear ends thereof for movement in an upright plane, (b) hoisting means associated with the rearwardly extending hull portions of the vessel and with said gate for moving said gate to selectively open and close the water area between the rearwardly extending hull portions, (c) hoisting means associated with said vessel to selectively move a barge or the like from the water area onto the vessel or to move a barge from the vessel into the water area.

* * * * *